US010612426B2

(12) United States Patent
Takagi

(10) Patent No.: US 10,612,426 B2
(45) Date of Patent: Apr. 7, 2020

(54) VALVE CLEARANCE ADJUSTING METHOD

(71) Applicant: SANYO MACHINE WORKS, LTD., Aichi (JP)

(72) Inventor: Yoshiaki Takagi, Aichi (JP)

(73) Assignee: SANYO MACHINE WORKS, LTD., Aichi (JP)

( * ) Notice: Subject to any disclaimer, the term of this patent is extended or adjusted under 35 U.S.C. 154(b) by 0 days.

(21) Appl. No.: 16/041,950

(22) Filed: Jul. 23, 2018

(65) Prior Publication Data

US 2019/0101030 A1 Apr. 4, 2019

(30) Foreign Application Priority Data

Oct. 4, 2017 (JP) ..... 2017-194341

(51) Int. Cl.
*F01L 1/20* (2006.01)
*F01L 1/053* (2006.01)
*F01L 1/18* (2006.01)

(52) U.S. Cl.
CPC ..... *F01L 1/20* (2013.01); *F01L 1/053* (2013.01); *F01L 1/181* (2013.01); *F01L 1/185* (2013.01); *F01L 2001/0535* (2013.01); *F01L 2001/0537* (2013.01); *F01L 2103/01* (2013.01); *F01L 2105/00* (2013.01); *F01L 2820/01* (2013.01)

(58) Field of Classification Search
None
See application file for complete search history.

(56) References Cited

U.S. PATENT DOCUMENTS 4,389,882 A * 6/1983 Noro ..... F01L 1/20 73/114.79
4,638,773 A * 1/1987 Bonvallet ..... F01L 1/2405 123/90.16
2006/0288973 A1* 12/2006 Hathaway ..... F01L 1/146 123/90.43

FOREIGN PATENT DOCUMENTS

JP 2830715 12/1998

* cited by examiner

*Primary Examiner* — Patrick Hamo
*Assistant Examiner* — Wesley G Harris
(74) *Attorney, Agent, or Firm* — Wenderoth, Lind & Ponack, L.L.P.

(57) ABSTRACT

Provided is a valve clearance adjusting method by which an accurate valve clearance adjustment can be easily performed regardless of the tolerance of pitch dimensions of an adjusting screw. The valve clearance adjusting method including: measuring a cam profile of the camshaft 50 mounted on the cylinder head 100; identifying, on the basis of a measurement result of the cam profile, a predetermined rotation angle $\theta_V$ of the camshaft 50 at which a predetermined lift amount corresponding to a predetermined valve clearance is obtained; rotating the camshaft 50 and allowing a pressed portion 61, 71 of the rocker arm 60, 70 to face a cam surface at the predetermined rotation angle $\theta_V$; rotating an adjusting screw 90 with the pressed portion faced with the cam surface and setting a valve clearance to zero; and fastening the adjusting screw 90 with a lock nut 91.

5 Claims, 5 Drawing Sheets

VALVE CLEARANCE ADJUSTING METHOD

BACKGROUND OF THE INVENTION

(1) Field of the Invention

The present invention relates to a valve clearance adjusting method for a valve mechanism and, in particular, to a valve clearance adjusting method for a valve mechanism configured to transmit driving force from a camshaft via a rocker arm to a valve.

(2) Description of Related Art

A valve mechanism, such as an OHV (Over Head Valve) valve mechanism, an OHC (Over Head Camshaft) valve mechanism, and a DOHC (Double Over Head Camshaft) valve mechanism, for an internal combustion engine is configured to transmit driving force from a camshaft via a rocker arm to a valve. In the case of adjusting a valve clearance in such a valve mechanism, a thickness gauge is interposed in a clearance between the valve and the rocker arm or in a clearance between the camshaft and the rocker arm and the thickness gauge is tightened with an adjusting screw; thereby the valve clearance is adjusted. If it is not allowed to use the thickness gauge, the adjusting screw is tightened until the valve clearance reaches zero. Afterward, on the basis of pitch dimensions of the adjusting screw, the adjusting screw is loosened at a predetermined number of rotations and thereby the valve clearance is adjusted.

As just described, it takes effort and time to adjust the valve clearance. Accordingly, in the invention disclosed in Japanese Patent No. 2830715 (hereinafter, Patent Document 1), a first cam profile is measured by rotating a camshaft at 360 degrees in a state where a valve clearance is set to zero. Meanwhile, a second cam profile is measured by rotating the camshaft at 360 degrees in a state where a temporary valve clearance is set by rotating an adjusting screw at a predetermined number of rotations. Then, an actual valve clearance is obtained from a differential value between the maximum lift amount of the first cam profile and the maximum lift amount of the second cam profile to be compared with the temporary valve clearance. Therefore, on the basis of whether the temporary valve clearance is within an allowable range, whether or not the temporary valve clearance is appropriate is determined.

SUMMARY OF THE INVENTION

According to the invention of Patent Document 1, measuring a cam profile needs to be done at least twice. Further, the temporary valve clearance is set on the basis of pitch dimensions of the adjusting screw. Therefore, if the tolerance of the pitch dimensions is large, the temporary valve clearance is out of the allowable range. Consequently, it is required that the adjusting screw is re-adjusted and then the cam profile measurement is performed again.

Thus, an object of the present invention is to provide a valve clearance adjusting method by which an accurate valve clearance adjustment can easily be performed regardless of the tolerance of pitch dimensions of an adjusting screw.

The foregoing drawback is solved by a valve clearance adjusting method according to an aspect of the present invention. The valve clearance adjusting method for a valve mechanism configured to transmit driving force from a camshaft via a rocker arm to a valve in a cylinder head, includes: measuring a cam profile of the camshaft mounted on the cylinder head; identifying, on the basis of a measurement result of the cam profile, a predetermined rotation angle $\theta_V$ of the camshaft at which a predetermined lift amount corresponding to a predetermined valve clearance is obtained; rotating the camshaft and allowing a pressed portion of the rocker arm to face a cam surface at the predetermined rotation angle $\theta_V$; rotating an adjusting screw in a state where the pressed portion is faced with the cam surface and setting a valve clearance to zero; and fastening the adjusting screw with a lock nut in a state where the valve clearance is zero.

According to the aspect of the present invention, it is enough to perform the cam profile measurement only once. In addition, the valve clearance can be accurately and easily adjusted regardless of the tolerance of pitch dimensions of the adjusting screw.

DETAILED DESCRIPTION OF PREFERRED EMBODIMENTS

Hereinafter, an embodiment according to the present invention will be described with reference to the drawings. The same reference number is assigned to the same or corresponding element in each of the drawings, and overlapping descriptions of the same or corresponding element are omitted. A valve clearance adjusting method according to the embodiment of the present invention is a method of easily and accurately adjusting a valve clearance with use of a lift amount of a cam profile.

(Overview of Cylinder Head)

Figure 1:
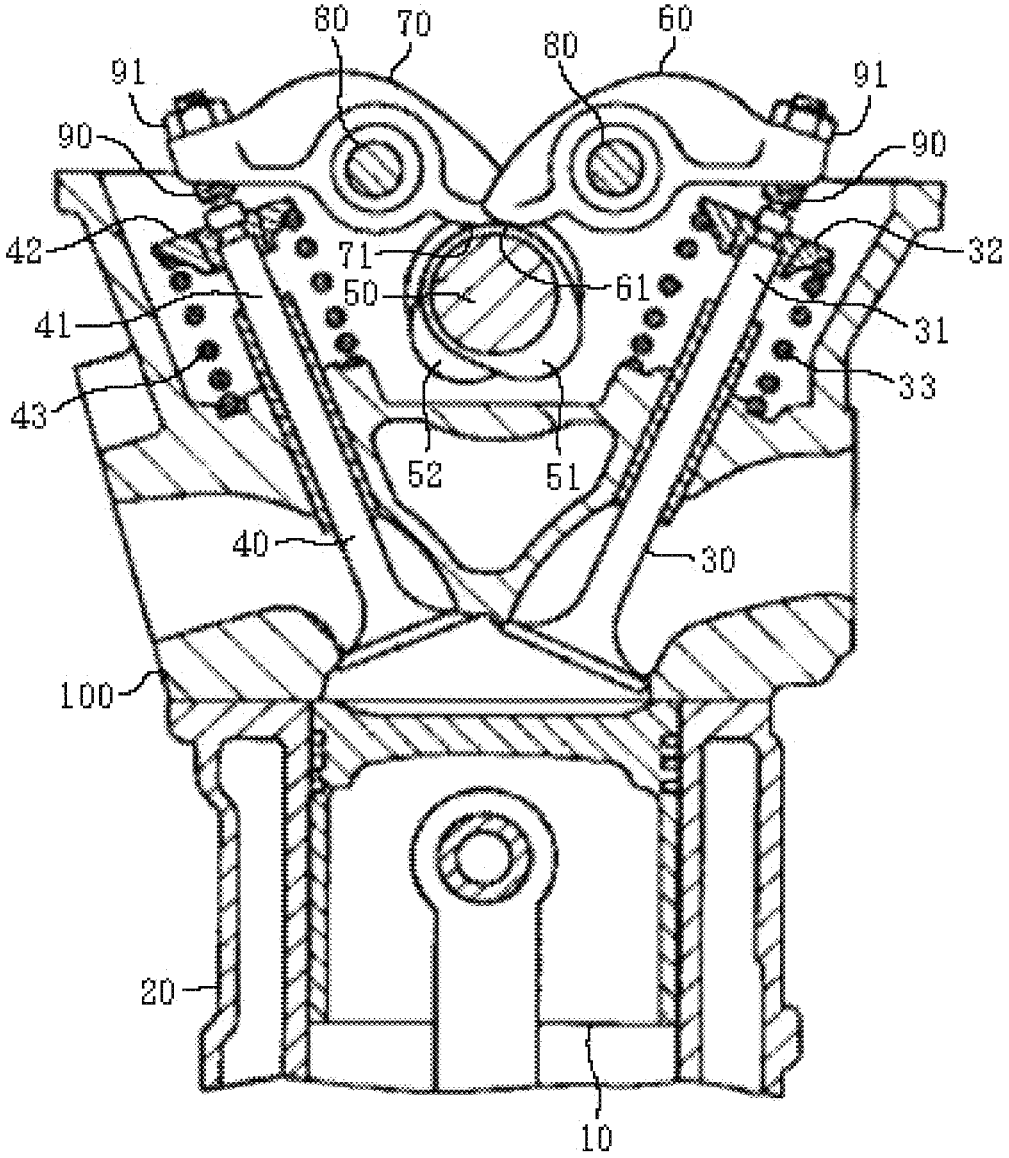
FIG. 1 is a schematic view of an SOHC (Single Over Head Camshaft) cylinder head to which a valve clearance adjusting method according to an embodiment of the present invention can be applied.

FIG. 1 is a schematic view of an SOHC (Single Over Head Camshaft) cylinder head 100 to which the valve clearance adjusting method according to the embodiment of the present invention can be applied. The cylinder head 100 including an intake valve 30 and an exhaust valve 40 is mounted on a cylinder block 20 in which a piston 10 is housed. Valve retainers 32, 42 are respectively attached to end portions of valve stems 31, 41, and the valve retainers 32, 42 are respectively biased by valve springs 33, 43 in a valve closing direction.

A camshaft 50 for the intake and exhaust valves is arranged in a central portion of the cylinder head 100. The camshaft 50 includes a cam lobe 51 for the intake valve and a cam lobe 52 for the exhaust valve. Driving force from the camshaft 50 is transmitted via right and left rocker arms 60, 70 to the valve stems 31, 41 of the intake and exhaust valves.

Respective central portions of the right and left rocker arms 60, 70 are swingably supported by support shafts 80 supported by the cylinder head 100. A pressed portion 61 on one end of a lower surface of the rocker arm 60, which is located adjacent to the center and a pressed portion 71 on one end of a lower surface of the rocker arm 70, which is located adjacent the center are in contact with the camshaft 50. An adjusting screw 90 is screwed toward the valve stem 31 in the other end portion at the outer side of the rocker arm 60 and an adjusting screw 90 is screwed toward the valve stem 41 in the other end portion at the outer side of the rocker arm 70. The adjusting screws 90 are fastened with respective lock nuts 91.

(Cam Profile)

Figure 2A:
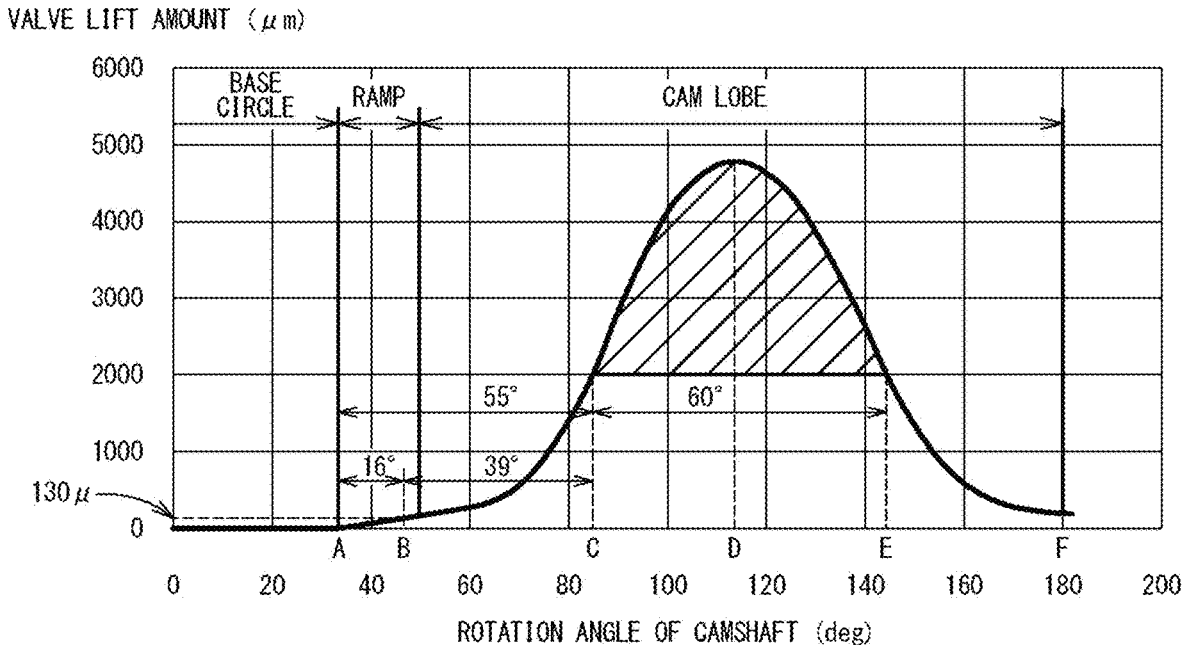
FIG. 2A shows a profile curve that illustrates an example of a cam profile of a camshaft.

FIG. 2A illustrates an example of a cam profile of the aforementioned camshaft 50. In FIG. 2A, a horizontal axis indicates a rotation angle (degrees) of the camshaft 50 and a vertical axis indicates a lift amount (μm) from a base circle.

Figure 2B:
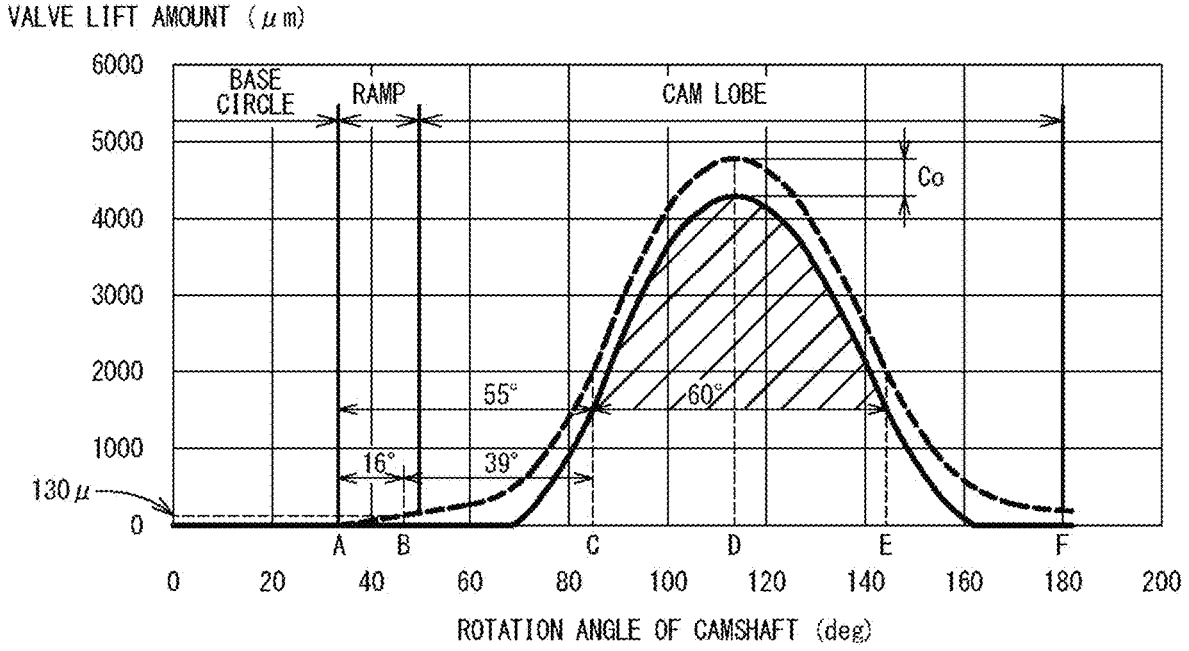
FIG. 2B shows a profile curve in a case where a valve clearance Co is provided in FIG. 2A.

The camshaft 50 is rotated one revolution (360 degrees) by a rotation drive device in a state where the camshaft 50 is mounted on the cylinder head 100; and whereby the valves are driven (opened and closed) and the lift amount of each of the valves is detected. Thus, the cam profile can be measured. FIG. 2B described below shows a cam profile measured when a temporary valve clearance Co is provided in a state where the camshaft 50 is mounted on the cylinder head 100.

A shaft that is a base material of the camshaft 50 is carried into a machining system; thereafter, a surface of a cam journal and a surface of each of the cam lobes are machined (rough machining, grinding, and finishing) on the basis of CAD data; thereby, the camshaft 50 is manufactured. The cam lobe of the manufactured camshaft 50 includes angular error with respect to a reference rotation direction of the journal and machining error of a cam surface itself.

However, an angular range C to E where a lift amount equal to or greater by a predetermined amount from the base circle can be obtained, configures a main portion of the cam profile and occupies a substantive position in the cam profile. Therefore, plural camshafts comprising the same cam profile have almost no error in relative positional relations from the base circle to each of portions (rotation angle θ and lift amount μm) of the cam profile over the entire angular range C to E.

As described above, according to the present invention focusing on the fact that camshafts including the same cam profile have almost no error of the relative positional relation of the main portion of the cam lobe to each of portions (rotation angle θ and lift amount μm) of the cam profile, the valve clearance is easily and accurately adjusted. In other words, the cam profile in FIG. 2A includes the base circle, the cam lobe, and a ramp smoothly connecting the base circle to the cam lobe. The valve clearance is set within a range of the ramp. In the example illustrated in FIG. 2A, the base circle, the ramp, and the cam lobe are respectively within an angular range of up to 32 degrees, an angular range of 32 of 49 degrees, and an angular range of 49 to 180 degrees.

Here, with the base circle defined as a reference (valve lift amount=zero), an angular range where the valve lift amount reaches, for example, 2000 μm or greater is obtained as the angular range C to E is 87 to 147 degrees from the cam profile in the FIG. 2A. A main portion of such a cam lobe occupies a central position in the cam profile. Therefore, a relative angle from the main portion C to E (87 to 147 degrees) to a predetermine position (θ) at which a predetermined lift amount (μm) is obtained accurately reflects the CAD data of the camshaft 50.

When the valve lift amount is 2000 μm or greater, the corresponding rotation angle is within the angular range C to E (87 to 147 degrees). Meanwhile, when the valve lift amount is 3000 μm or greater, the corresponding rotation angle is within a narrower range. In addition, when the valve lift amount is 4000 μm or greater, the corresponding rotation angle is within an extremely small range of the apex of the cam lobe. As just described, when an angular range becomes smaller, the change of inclination of both ends of the profile curve in the angular range increases. In such a case, less number of measurement samples of the lift amount (μm) on the vertical axis with respect to the rotation angle (θ) on the horizontal axis could result in more amount of error of the angular range.

On the other hand, when the valve lift amount is smaller than 2000 μm, for example, when the valve lift amount is 300 μm or greater, the corresponding rotation angle is within a larger angular range where the ramp sections are partially included in the both ends of the cam profile curve. Accordingly, the inclination of the both ends of the cam profile curve decreases and therefore the error of the angular range may be large similarly as above.

Consequently, the valve lift amount for defining an appropriate angular range of the main portion of the cam lobe is preferably 30 to 60% of the maximum lift amount (4800 μm at position D), and more preferably 40 to 50% of the maximum lift amount. The aforementioned valve lift amount of 2000 μm corresponds to 42% of the maximum lift amount of 4800 μm.

(Valve Clearance Adjusting Method)

The angle at which the lift amount of the cam profile reaches 130 μm is located at position B (rotation angle of 48 degrees) traced back by 39 degrees from position C (rotation angle of 87 degrees) on the increase side of the main portion C to E of the cam lobe according to the CAD data of the cam shaft 50. Position B is the position reached as a result of ascending the ramp section (rotation angle of 32 to 49 degrees) by 94% of the rotation angle.

In the case of adjusting the valve clearance to 130 μm, the camshaft 50 is rotated by the rotation drive device to bring the pressed portion 61 on one end of the rocker arm 60 and the pressed portion 71 on one end of the rocker arm 70 into contact with the cam surface at position B (rotation angle of 48 degrees). In such a state, the adjusting screws 90 are tightened and fastened with the lock nuts 91 whereby the valve clearance adjustment is completed.

As described above, according to the embodiment of the present invention, it is enough to perform the cam profile measurement only once. Also, the accurate valve clearance adjustment can easily performed regardless of the tolerance of pitch dimensions of the adjusting screw 90.

The valve clearance can be adjusted to increase or decrease from 130 μm. To decrease the valve clearance from the 130 μm, the camshaft 50 is rotated by the rotation drive device to a position (adjacent to position A in FIG. 2A) at which the lift amount of the cam profile is smaller than 130 μm; whereby, the pressed portion 61 on one end of the rocker arm 60 and the pressed portion 71 on one end of the rocker arm 70 are brought into contact with the cam surface at the position. Then, the adjusting screws 90 are tightened and fastened with the lock nuts 91.

On the other hand, to increase the valve clearance from 130 μm, the camshaft 50 is rotated in the opposite direction; whereby, the pressed portion 61 on one end of the rocker arm 60 and the pressed portion 71 on one end of the rocker arm 70 are brought into contact with the cam surface located close to the limit (49 degrees) of the ramp section. Then, the adjusting screws 90 are tightened and fastened with the lock nuts 91 in the same way as above.

Figure 3A:
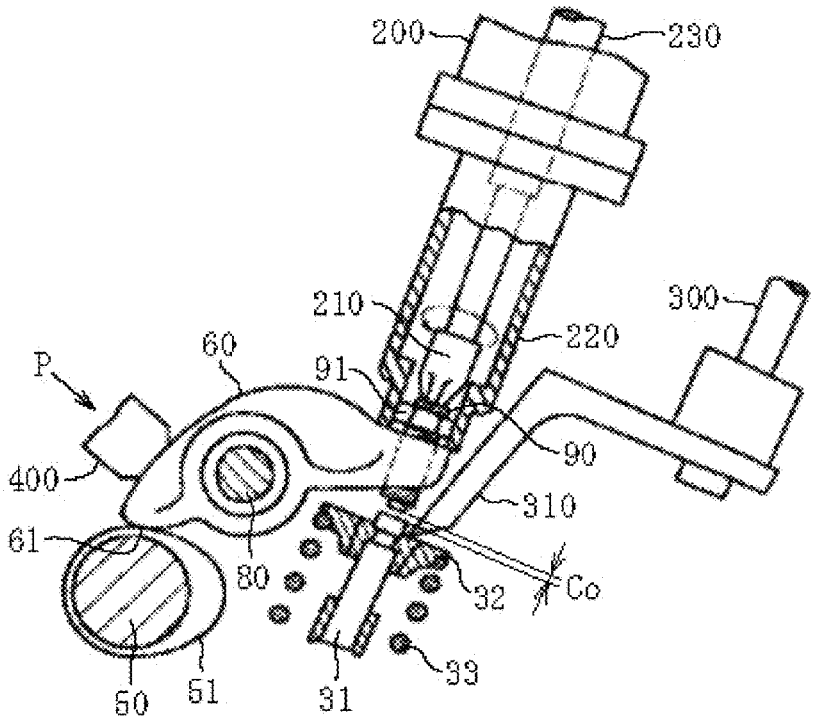
FIG. 3A is a schematic view illustrating an example of a clearance adjusting tool and other tools that are used in the valve clearance adjusting method according to the embodiment of the present invention.
Figure 3B:
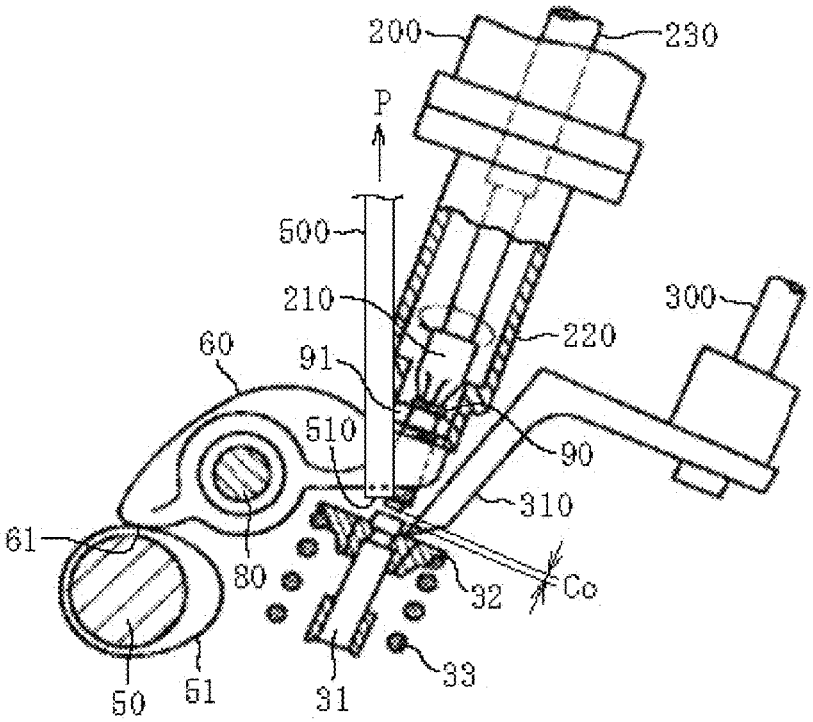
FIG. 3B is a schematic view illustrating another example of the clearance adjusting tool and other tools that are used in the valve clearance adjusting method according to the embodiment of the present invention.
Figure 4:
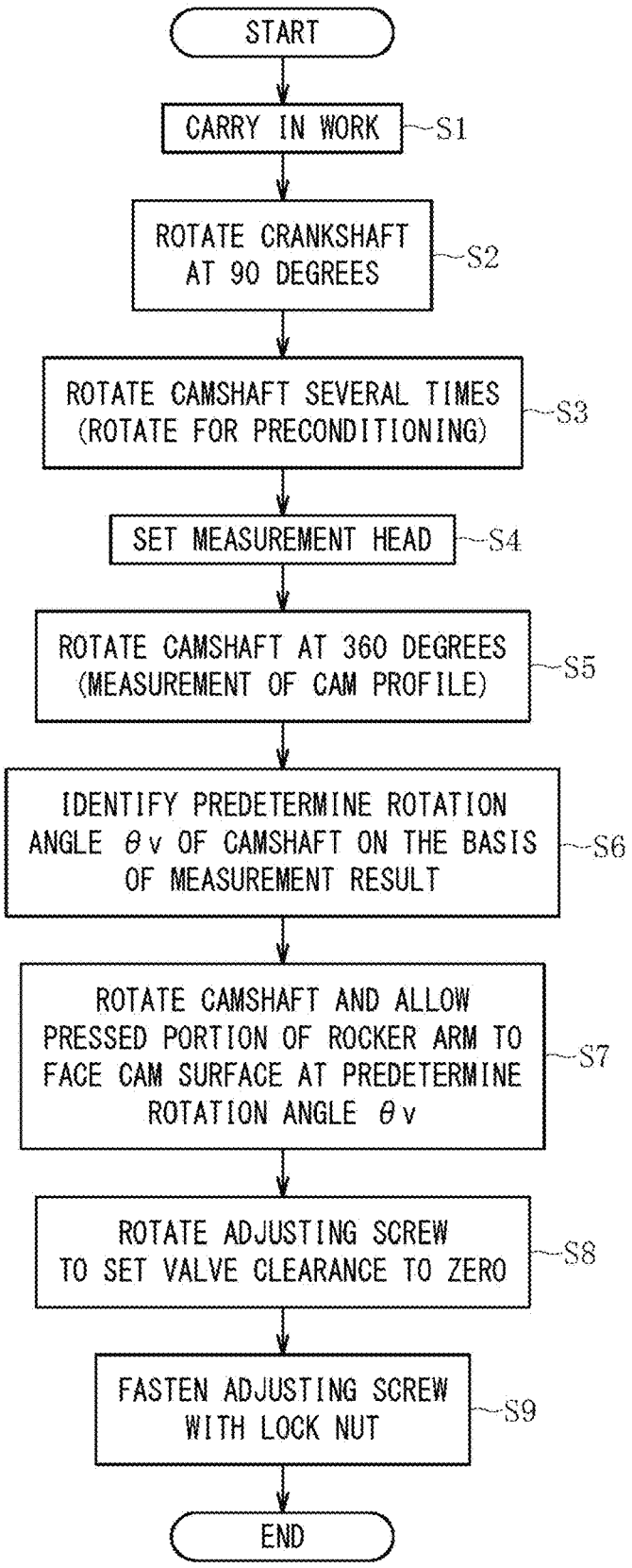
FIG. 4 is a flowchart illustrating an example of the valve clearance adjusting method according to the embodiment of the present invention.

Next, the aforementioned valve clearance adjusting method will be further concretely described in the embodiment of FIG. 3A, FIG. 3B, and FIG. 4. Taking the valve clearance adjustment of the intake valve 30 in FIG. 1 as an example, FIG. 3A shows a concrete example of tools used in the adjustment, illustrating a clearance adjusting tool 200, a valve lift amount measuring tool 300, and a pusher 400. FIG. 3B shows a puller 500 provided in place of the pusher 400 in FIG. 3A, and other configurations in FIG. 3B are the same as those in FIG. 3A.

The clearance adjusting tool 200 includes a bit 210 configured to rotate the adjusting screw 90, a socket 220 arranged coaxially on the outer circumferential side of the bit 210 to rotate the lock nut 91, and a rotation mechanism 230 configured to rotate the bit 210 and the socket 220. The clearance adjusting tool 200 is held by a robot or the like (not shown) to be placed at a predetermined position above the intake valve 30.

The valve lift amount measuring tool 300 includes a probe pawl 310 contactable with an upper surface of the valve retainer 32, and the valve lift amount measuring tool 300 is placed at a predetermine position by a robot or the like (not shown). In addition, the probe pawl 310 is configured to detect an upward and downward stroke of the intake valve 30 when the camshaft 50 is rotated by the rotation drive device.

Also, a position with which the probe pawl 310 is brought into contact is not limited to the upper surface of the valve retainer 32. In other words, if the valve lift amount is measured only with the cylinder head 100 before the cylinder head 100 is connected to the cylinder block 20 as in FIG. 1, the probe pawl 310 can be directly brought into contact with a lower surface of the intake valve 30 to measure the valve lift amount. In this manner, the probe pawl 310 is directly brought into contact with the intake valve 30; therefore, measuring accuracy can be increased.

The pusher 400 in FIG. 3A is held by a robot or the like (not shown) and is configured to push, in the direction indicated by arrow P, one end of an upper surface of the rocker arm 60. In addition, the pusher 400 is pushed in the direction indicated by arrow P and thereby the pressed portion 61 on one end of the lower surface of the rocker arm 60 is brought into contact with the camshaft 50.

Meanwhile, the puller 500 in FIG. 3B includes an L-shaped engagement portion 510 at an end portion of the puller 500. The puller 500 is pulled in the direction indicated by arrow P in a state where the engagement portion 510 is in contact with the other end of the lower surface of the rocker arm 60. Therefore, the pressed portion 61 on one end of the lower surface of the rocker arm 60 is brought into contact with the camshaft 50. The magnitude of pulling force in the direction indicated by arrow P is preferably set so as to produce moment equal to the moment applied by biasing force of the valve spring 33 to the rocker arm 60. Thus, the valve clearance can be set in consideration of the deflection of the rocker arm 60 deformed by the biasing force of the valve spring 33.

The valve clearance is adjusted as follows. First, as shown in FIG. 3A or FIG. 3B, the camshaft 50 is rotated as appropriate by the rotation drive device to a rotation angle B at which the lift amount corresponding to the aforementioned valve clearance of 130 μm from the base circle is obtained. Therefore, the cam surface (an upper surface of the camshaft 50 in FIG. 3A or FIG. 3B) corresponding to the rotation angle B faces the pressed portion 61 of the rocker arm 60.

In a state where the cam surface is faced with the pressed portion 61, the pressed portion 61 of the rocker arm 60 is brought into contact with the cam surface with use of the pusher 400. Therefore, the rocker arm 60 swings left around the support shaft 80 and a clearance Co is formed between the valve stem 31 and an end portion of the adjusting screw 90 located on the opposite side of the pressed portion 61. The clearance Co is a valve clearance before the valve clearance adjustment is performed. Under this condition, the adjusting screw 90 is tightened with the bit 210 to make the clearance Co zero.

When the adjusting screw 90 is excessively tightened with the bit 210, the intake valve 30 may open. As a result, the valve clearance becomes too small. The adjusting screw 90 may be maximally tightened with the bit 210 until the moment when a valve-opening stroke of the intake valve 30 is going to start.

The moment of staring of the valve-opening stroke can be accurately detected by the probe pawl 310 of the valve lift amount measuring tool 300. In accordance with the detection signal, the rotation mechanism 230 rotating the bit 210 can automatically stop. After tightening of the adjusting screw 90 is stopped, the adjusting screw 90 is fastened with the lock nut 91 whereby the valve clearance adjustment is completed.

The cam profile is measured in the condition in FIG. 3A or FIG. 3B, that is, in a state where the camshaft 50 is mounted on the cylinder head 100. In other words, in a state where the camshaft 50 is mounted on the cylinder head 100 as in FIG. 3A or FIG. 3B, the cam profile in FIG. 2B can be obtained with use of the aforementioned valve lift amount measuring tool 300.

At the time of measuring the cam profile, the cylinder head 100 and the cylinder block 20 are not necessarily required to be connected to each other as in FIG. 1. The cam profile can be measured only with the cylinder head 100. It is noted that when the cylinder head 100 is connected to the cylinder block 20, tightening torque of bolts used in connecting may affect the measured cam profile. Therefore, the cam profile is preferably measured in a state where the cylinder head 100 is connected to the cylinder block 20.

Also, at the time of measuring the cam profile, the valve lift amount measuring tool 300 should be arranged so that a stroke direction of the probe pawl 310 of the valve lift amount measuring tool 300 may be parallel with an axis line of the valve stem 31 of the intake valve 30 as much as possible. Such a parallelism is not precisely obtained, the lift amount of the cam profile in FIG. 2B may entirely decrease. However, the angular range C to E (87 to 147 degrees) of the cam lobe can be accurately obtained as desired because the stroke of the probe pawl 310 is proportional to the valve lift amount regardless of the parallelism.

The height of a cam lobe in FIG. 2B is smaller than the height of the cam lobe in FIG. 2A by the valve clearance Co that is temporarily provided. However, even in the cam profile in FIG. 2B, a main portion of the cam lobe C to E (87 to 147 degrees) can be detected, as indicated with diagonal lines. Therefore, a rotation angle $\theta_V$ (position B) of the camshaft 50 at which the lift amount corresponding to the valve clearance of 130 μm is obtained can be identified. In other words, position B is not necessarily required to be directly detectable. After the rotation angle $\theta_V$ (position B) is identified, the valve clearance can be adjusted by the same method as described above.

(Flowchart)

Next, the valve clearance adjusting method will be described with reference to FIG. 4. In step S1, a work (the cylinder block on which the cylinder head is mounted) is carried in to a valve clearance adjusting line. Here, a rotation angle of the crankshaft is regulated so that the piston in each of cylinders of the cylinder block 20 is positioned at an upper dead point or a lower dead point, and the work is carried in a state where a timing belt is removed.

In step S2, the crankshaft is rotated at 90 degrees by the rotation drive device so that the valves 30, 40 may not make contact with the piston 10 at the time of measuring a cam profile. Then, in step S3, the camshaft 50 is rotated several times and its movable portion is preconditioned.

In step S4, the valve lift amount measuring tool 300 (a measuring head) is set at a predetermine position above the valve. Then, in step S5, the camshaft 50 is rotated at 360 degrees by the rotation drive device. Therefore, the intake valve 30 moves up and down and the cam profile measurement is performed by the valve lift amount measuring tool 300.

In step S6, the rotation angle $\theta_V$ is identified on the basis of a measurement result by the valve lift amount measuring tool 300. The rotation angle $\theta_V$ is obtained from position B in FIG. 2A or FIG. 2B showing the cam profile and is the angle at which the lift amount corresponding to the valve clearance of 130 μm is obtained.

In step S7, the camshaft 50 is rotated by the rotation drive device to allow the cam surface (the cam surface in the ramp section) at the rotation angle $\theta_V$ to face the pressed portion 61 of the rocker arm 60. Then, the pressed portion 61 of the rocker arm 60 is brought into contact with the facing cam surface with use of the pusher 400. Afterward, in step S8, the adjusting screw 90 is rotated with the bit 210 of the clearance adjusting tool 200 and thereby the valve clearance is set to zero.

In step S9, the socket 220 of the clearance adjusting tool 200 is rotated and thereby the lock nut 91 is tightened to fasten the adjusting screw 90. Thus, the valve clearance adjustment is completed.

(DOHC (Double Over Head Camshaft) Cylinder Head)

The valve clearance adjusting method is described as above, taking the SOHC cylinder head as an example. The valve clearance adjusting method according to the embodiment of the present invention can be applied to a non-direct acting DOHC cylinder head shown in FIG. 5.

Figure 5:
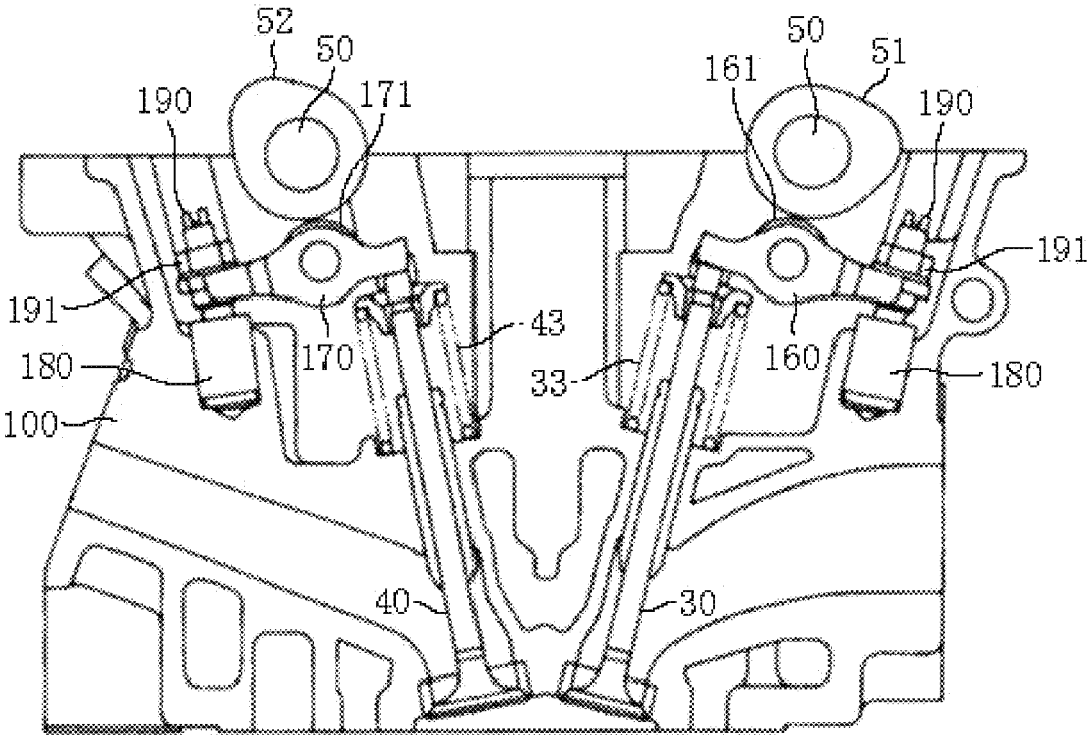
FIG. 5 is a schematic view of a DOHC (Double Over Head Camshaft) cylinder head to which the valve clearance adjusting method according to the embodiment of the present invention can be applied.

FIG. 5 can be simply expressed as follows. Rocker arms 160, 170 are provided between a pair of right and left camshafts 50 and the intake valve 30 and the exhaust valve 40. Base ends of the rocker arms 160, 170 are respectively supported by rocker arm pivots 180 and distal ends of the rocker arms 160, 170 respectively extend to face the top of the head of the intake valve 30 and the top of the head of the exhaust valve 40.

A roller 161 serving as the pressed portion is rotatably supported at an intermediate position between the base end and the distal end of the rocker arm 160 so as to face the camshaft 50 and a roller 171 serving as the pressed portion is rotatably supported at an intermediate position between the base end and the distal end of the rocker arm 170 so as to face the camshaft 50. In addition, the rocker arm 160 is configured to swing the distal end around the base end in accordance with the rotation of the camshaft 50, thereby opening and closing the intake valve 30. Likewise, the rocker arm 170 is configured to swing the distal end around the base end in accordance with the rotation of the camshaft 50, thereby opening and closing the exhaust valve 40.

An adjusting screw 190 and a lock nut 191 are provided at the base end of the rocker arm 160 to adjust a valve clearance formed between a base circle of the camshaft 50 and the roller 161 of the rocker arm 160, and an adjusting screw 190 and a lock nut 191 are provided at the base end of the rocker arm 170 to adjust a valve clearance formed between a base circle of the camshaft 50 and the roller 171 of the rocker arm 170. The adjusting screws 190 are rotated in the same way as described above and thereby the valve clearances can be adjusted.

The embodiment of the present invention has been described as above, but the present invention is not limited to the foregoing embodiment and various changes can be made to the embodiment. For example, the valve clearance adjusting tool 200, the valve lift amount measuring tool 300, and the pusher 400 are used to adjust the valve clearance in the embodiment of FIG. 3A. Alternatively, instead of these tools, one or two different tools having the equivalent functions are applied whereby the valve clearance can be adjusted.

What is claimed is:

1. A valve clearance adjusting method for a valve mechanism configured to transmit driving force from a camshaft via a rocker arm to a valve in a cylinder head, the valve clearance adjusting method comprising:

measuring a cam profile of the camshaft mounted on the cylinder head;

identifying, based on a measurement result of the cam profile, a rotation angle $\theta_V$ of the camshaft at which a predetermined lift amount corresponding to a predetermined valve clearance is obtained;

rotating the camshaft and allowing a pressed portion of the rocker arm to face a cam surface at the rotation angle $\theta_V$;

rotating an adjusting screw in a state where the pressed portion is faced with the cam surface and setting a valve clearance to zero; and fastening the adjusting screw with a lock nut in a state where the valve clearance is zero.

2. The valve clearance adjusting method according to claim 1, wherein when the rotation angle $\theta_V$ of the camshaft is identified based on the measurement result of the cam profile of the camshaft, a rotation angle range $\theta_C$ to $\theta_E$ of the camshaft in which a lift amount equal to or greater than the predetermined lift amount of the cam profile is obtained, and a rotation angle separated from the rotation angle range $\theta_C$ to $\theta_E$ by a predetermined amount toward a decrease side in a valve lift amount is identified as the rotation angle $\theta_V$.

3. The valve clearance adjusting method according to claim 2, wherein the measuring of the cam profile includes driving the valve by rotating the camshaft mounted on the cylinder head to measure a lift amount of the valve and the cam profile.

4. The valve clearance adjusting method according to claim 1, wherein the measuring of the cam profile includes driving the valve by rotating the camshaft mounted on the cylinder head to measure a lift amount of the valve and the cam profile.

5. The valve clearance adjusting method according to claim 1, wherein the valve mechanism is one of an over head valve (OHV) valve mechanism, an over head camshaft (OHC) valve mechanism, and a double over head camshaft (DOHC) valve mechanism.

* * * * *